United States Patent [19]

Kitahara et al.

[11] Patent Number: 4,900,009

[45] Date of Patent: Feb. 13, 1990

[54] SORTER

[75] Inventors: Makoto Kitahara, Tokyo; Masataka Naito, Kawasaki; Yuji Takahashi, Tokyo, all of Japan

[73] Assignee: Canon Kabushiki Kaisha, Tokyo, Japan

[21] Appl. No.: 183,705

[22] Filed: Apr. 19, 1988

[30] Foreign Application Priority Data

| | | | |
|---|---|---|---|
| Apr. 20, 1987 | [JP] | Japan | 62-096944 |
| Apr. 20, 1987 | [JP] | Japan | 62-096945 |
| Apr. 20, 1987 | [JP] | Japan | 62-096946 |
| Apr. 20, 1987 | [JP] | Japan | 62-096947 |

[51] Int. Cl.[4] ..... B65H 39/10

[52] U.S. Cl. ..... 271/296; 271/288; 271/292; 271/304

[58] Field of Search ..... 271/296, 302, 287, 288, 271/293, 298, 292, 304

[56] References Cited

U.S. PATENT DOCUMENTS

| | | | |
|---|---|---|---|
| 4,405,225 | 9/1983 | Perrault | 271/296 |
| 4,478,406 | 10/1984 | Dubois | 271/293 |
| 4,498,665 | 2/1985 | Watanabe | 271/289 |

FOREIGN PATENT DOCUMENTS

| | | | |
|---|---|---|---|
| 3141447 | 4/1982 | Fed. Rep. of Germany . | |
| 0102467 | 6/1982 | Japan | 271/287 |
| 0135061 | 8/1983 | Japan | 271/287 |
| 0212552 | 12/1983 | Japan | 271/287 |
| 0220059 | 12/1983 | Japan | 271/293 |

*Primary Examiner*—Andres Kashnikow
*Assistant Examiner*—Christopher G. Trainor
*Attorney, Agent, or Firm*—Fitzpatrick, Cella, Harper & Scinto

[57] ABSTRACT

A sheet material distributing apparatus includes a plurality of bins for accommodating sheet materials, a first sheet material gripping and conveying device displaceable to be opposed to a sheet material inlet of each of the bins, and a second sheet material gripping and conveying device displaceable to receive a sheet material from a sheet material discharging device and for transferring the sheet material to the first sheet material gripping and conveying device.

14 Claims, 16 Drawing Sheets

SORTER

FIELD OF THE INVENTION AND RELATED ART

The present invention relates to a sorter which distributes sheet materials discharged sequentially from sheet a material discharging device and which accommodates them on a plurality of sheet material accommodating means called bins.

The sheet material discharging device may be an image forming apparatus such as a copying apparatus and a printer, which discharges or outputs one by one sheet materials such as cut sheets, cards and other sheet like materials.

Conventional sheet material sorting machines (sorter) are generally divided into two types, i.e., a movable bin type sorter and a fixed bin type sorter.

The movable bin type sorter is such that the entirety of plural bins is moved as a unit relative to a sheet material discharge outlet of a sheet material discharging device, so that the inlet portions of the individual inlets of the bins are sequentially opposed to the sheet material discharge outlet to distribute the sheet materials to the individual bins.

A fixed bin type sorter is such that the bins are maintained stationary, and a sheet passage mechanism is provided which includes guiding plates and deflecting plates to selectively distribute the sheet materials from the sheet material discharge outlet to the individual inlets of the bins, whereby the discharged sheet materials are delivered to the individual bins.

It is considered that the fixed bin type sorter is provided with a movable sheet material delivering means which is controlled and reciprocally moved in the space between the sheet discharge outlet and the sheet material inlets of the individual bins and which receives the sheet materials each time they are discharged from the sheet material discharge outlet and sequentially delivers the sheet materials to the individual sheet inlets of the bins.

FIG. 1 shows an example of this type sorter, wherein the main apparatus from which the sheet material is discharged is designated by a reference A, which is an electrophotographic copying machine in this example. The main apparatus A is provided with a sheet material discharge outlet 70. A sorter C is disposed adjacent to the sheet material discharge outlet of the main apparatus A. In this example, the sorter C is in the form of an attachment, which is attached to the main apparatus A when to be used, or in the form of the equipment fixed to the main apparatus A.

The sorter C includes a plurality of bins 1*a*, 1*b*, 1*c*, 1*d*, 1*e*, 1*f*, 1*g*, 1*h* and 1*j* fixedly arranged vertically. There is provided a sheet material gripping and conveying means, which will hereinafter be called "a delivering unit" (sheet material delivering means), which is controlled and vertically movable in a space between the sheet discharge outlet of the main apparatus A and a sheet inlet side of the vertically arranged bins 1*a*–1*j*. The delivering unit includes a couple of rollers 61 and 62 for gripping and conveying the sheet material, an unshown motor for driving the rollers 61 and 62 and a sensor 63 for detecting the presence of the sheet material. The delivering unit 60 is mounted and supported on a belt 66 which runs on a bottom driving pulley 64 and a top follower pulley 65, by means of which it is controlled and vertically moved by forward and backward rotations of the belt 66 controlled by the driving pulley 64.

(1) When a start key (not shown) of the main apparatus A (copying machine) is depressed, the copying operation of the main apparatus A is started. In the sorter C, the delivering unit 60 is normally maintained at a home position where it is opposed to a sheet material discharge outlet 70 of the main apparatus A. However, if it is not at the home position when the start key is depressed, the driving pulley 64 is rotated forwardly or backwardly so as to place it at the home position (initial setting).

(2) The driving motor is actuated for the forward rotation of the rollers 61 and 62 of the delivery unit 60.

(3) A copy sheet material is introduced from the main apparatus A into the sorter C through the discharge outlet 70.

(4) The sheet material now introduced into the sorter C is directed into a nip formed between the rollers 61 and 62 of the delivery unit 60 waiting for the sheet material at the sheet discharge outlet 70, the rollers 61 and 62 rotating forwardly.

(5) When the leading edge portion of the sheet material is passed through the nip formed between the rollers 61 and 62 by a predetermined distance, the sensor 63 detects the presence of the sheet material, in response to which the rotation of the rollers 61 and 62 is stopped. By this, the leading edge portion of the sheet material is securedly gripped by the nip formed between the rollers 61 an 62. Also, in response to the detection signal, the forward rotation of the driving pulley 64 is started, so that the delivering unit 60 is moved upwardly at the speed which is substantially the same as the sheet discharging speed of the sheet discharge outlet 70.

(6) When the delivering unit 60 reaches a position where it is opposed to the sheet material inlet of a predetermined bin, more particularly, the topmost bin 1*a* in this example, the upward movement of the delivering unit 60 is stopped instantaneously. Simultaneously, the rotation of the rollers 61 and 62 is resumed, by reason of which the sheet material the leading edge portion of which has been gripped by the rollers 61 and 62 is delivered or discharged onto the bin 1*a*.

(7) When the sensor 63 detects the discharge of the sheet material onto the bin 1*a* by detecting the trailing edge of the sheet material, the delivery unit 60 is moved downwardly by a reversed rotation of the driving pulley 64, and it is returned to the home position where it is opposed to the sheet material discharge outlet 70, so that it is prepared for receiving the next sheet material.

(8) Subsequently, the operations including the sheet material transportation from the sheet discharge outlet 70 to the sheet material inlet of the bin by the delivery unit 60 and the returning of the delivering unit 60 to the sheet discharge outlet 70 after the sheet delivery to the bin, are repeated similarly to the steps (3)–(7), for the individual bins 1*b*, 1*c* . . . , whereby the sheet materials are distributed to the individual bins.

For the bins disposed below the home position of the delivering unit, the sheet materials are delivered by the downward movement of the delivering unit 60, and the delivering unit 60 is returned to the home position by the upward movement.

In this type of sorter of FIG. 1, the returning operation of the delivering unit 60 from each of the sheet inlets of the bins to the home position, is possible only after the sheet material delivered to a bin by the delivering operation is introduced onto the bin by the rotation of the rollers 61 and 62 and after the trailing edge of the sheet material is completely released from the nip between the rollers 61 and 62. Therefore, where the sorter C is used with a main apparatus A in which the spatial or time intervals between the sequentially discharged sheet materials is short, as in a high speed copying machine, the returning operation of the delivering unit 60 must be performed at an extremely high speed so as to meet the short spatial or time intervals. This extremely high speed requires use of a high power driving motor consuming much electricity. Also, the sorter mechanism is imparted with a heavy load with the resultant necessity of increasing strength of the mechanism. Accordingly, the sorter C becomes bulky and costly.

It may be considered that the distance between the home position of the delivering unit 60 and the sheet inlet portions of the most distant bins 1*a* and 1*j* is made short to reduce the maximum required time for the returning of the delivering unit 60 in an attempt to meet the sheet materials discharged at short spatial or time intervals from a high speed type main apparatus A. This, however, leads to the result that the total number of the bins (total number of stages) must be reduced or otherwise the intervals between the adjacent bins must be reduced. The reduction of the bin number means the reduction of the number of sets of sortable sheets, while the reduction of the bin intervals means reduction of the capacity of each of the bins.

SUMMARY OF THE INVENTION

Accordingly, it is a principal object of the present invention to provide a sheet material distributing apparatus by which the sheet materials can be sorted at a high speed without reduction of the sortable sets of sheet materials.

According to one aspect of the present invention, there is provided a sheet material sorting apparatus comprising a plurality of bins for accommodating sheet materials, first sheet material gripping and conveying means displaceable to be opposed to individual sheet material inlets of the bins and second sheet material gripping and conveying means for receiving the sheet material discharged from the sheet material discharge outlet and for transferring the sheet material to set first sheet material gripping and conveying means.

By the provision of the first and second sheet material gripping and conveying means as the sheet material delivering means, (1) The sheet material discharged from the sheet material discharging apparatus is gripped at a predetermined position by the second sheet material gripping and conveying means, the second sheet material gripping and conveying means is displaced to the position of the first sheet material gripping and conveying means placed at the sheet material inlet of a predetermined bin. The sheet material is transferred from the second sheet material gripping and conveying means to the first sheet material gripping and conveying means, and the sheet material is delivered onto a predetermined bin by the first sheet material gripping and conveying means.

(2) After the sheet material is transferred from the second sheet material gripping and conveying means moved to the position of the first sheet material gripping and conveying means placed at the sheet material inlet of a predetermined bin, to the first sheet material gripping and conveying means, and the leading edge portion thereof is gripped by the first sheet material gripping and conveying means, the second sheet material gripping and conveying means is returned to the predetermined position. In this manner, the sheet materials are sequentially delivered to the individual bins.

Since the sheet materials are distributed in this manner, after the sheet material is transferred from the second sheet material gripping and conveying means to the first sheet material gripping and conveying means, and the leading edge portion of the sheet material is transferred to and gripped by the first sheet material gripping and conveying means, the second sheet material gripping and conveying means can be immediately returned to the predetermined position to receive the next sheet material, without waiting for the sheet material to be completely discharged onto the bin after passing through the second and first sheet material gripping and conveying means. Accordingly, the sorter can meet the short spatial or time intervals of a high speed sheet material discharging apparatus, without specially increasing the returning speed of the second sheet material gripping and conveying means or without reducing the total number of the bins or the distance between the adjacent bins.

As will be understood from the above paragraph (2), even if the second sheet material gripping and conveying means is immediately returned, the leading edge portion of the sheet material transferred from the second sheet material gripping and conveying means to the first sheet material gripping and conveying means is securely transferred to and gripped by the first means, and therefore, there occurs no trouble in conveyance, and the transferred sheet material is discharged onto a predetermined bin by the first sheet material gripping and conveying means.

Therefore, the intended object is achieved, and the sorter according to this aspect of the present invention is particularly effective as a sheet material distributer used with a high speed copying machine or the like.

According to another aspect of the present invention, the second sheet material gripping and conveying means is also returned to the predetermined position after it transfers the sheet material to the first sheet material gripping and conveying means, and the sheet material conveying speed $V_R$ of the second sheet material gripping and conveying means during the returning stroke is substantially equal to a sum (V1+V2) of the sheet material conveying speed V1 of the first sheet material gripping and conveying means and the returning speed V2 of the second sheet material conveying means; or, the sheet gripping and conveying force of the second sheet material gripping and conveying means is released. By this feature, the portion of the sheet material between the first and second sheet material gripping and conveying means is not imparted by tension, friction force or bending force, whereby the sheet material is stably conveyed to a predetermined bin by the first sheet material gripping and conveying means, and is smoothly conveyed and discharged.

According to a further aspect of the present invention, the first sheet material gripping and conveying means is returned to the home position each time it receives the sheet material. By this feature, the first sheet gripping and conveying means will suffice if it sequentially reciprocates between its home position and the sheet material inlets of the individual bins, and the maximum reciprocating range can be made relatively smaller if the home position is determined properly in terms of the most distant bin. Therefore, the sorter can meet the short spatial or time intervals between the sheet materials discharged by a high speed discharging apparatus, without making the returning speed of the first and second sheet material gripping and conveying means to the respective home positions extremely high, or without reducing the number of bins or reducing the intervals between the adjacent bins.

According to a further aspect of the present invention, the first sheet material gripping and conveying means is provided with a bin position detecting means, and the second sheet material gripping and conveying means is provided with a detecting means for detecting a position of the first sheet material gripping and conveying means. By this feature, the positioning of the first sheet material gripping and conveying means relative to the respective bin positions and the positioning of the second gripping and conveying means relative to the first sheet material gripping and conveying means can be performed with a small number of parts, with a simple structure and with high precision and reliability.

DESCRIPTION OF THE PREFERRED EMBODIMENTS

Figure 1:
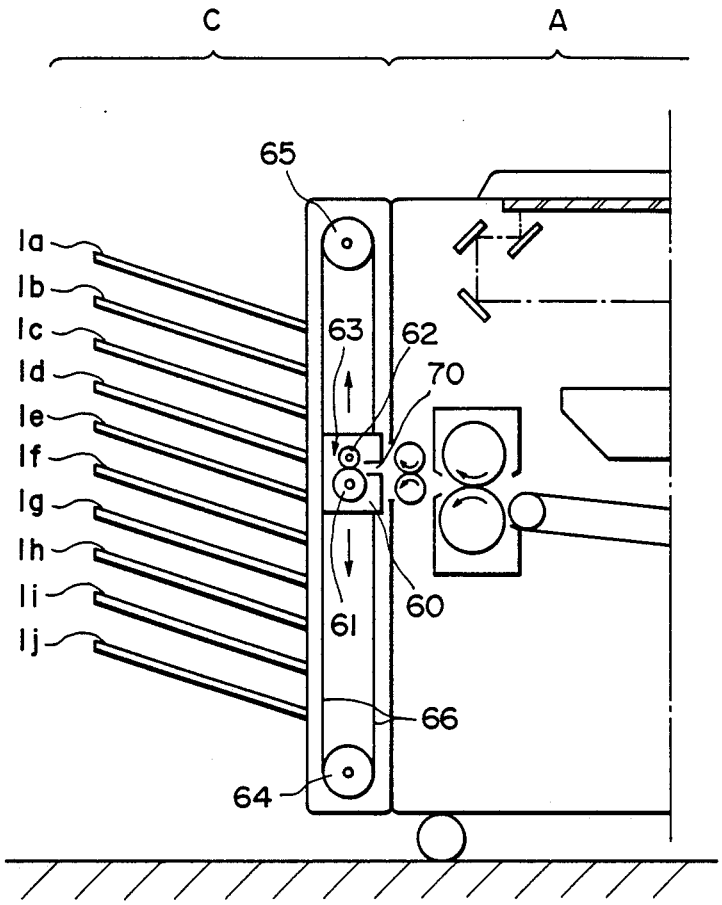
FIG. 1 PRIOR ART
FIG. 1 is a sectional view of an example of a sorter not using the present invention.
Figure 2:
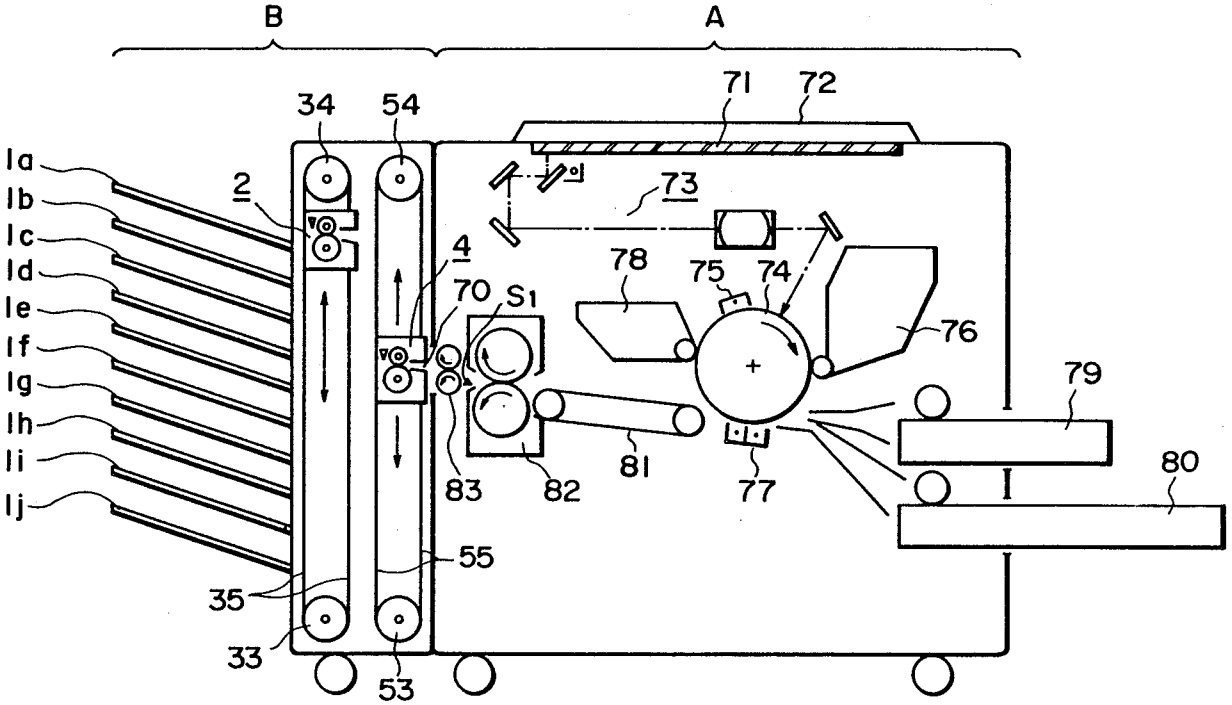
FIG. 2 is a sorter according to the present invention and a sectional view of an electrophotographic copying machine equipped with the sorter.

Referring to FIG. 2, there is shown a general arrangement of an electrophotographic copying machine as an exemplary sheet material discharging device A and a sorter as an exemplary sheet material distributing device B, according to an embodiment of the present invention, attached thereto at the sheet material discharging side.

The structure and image forming process of the copying machine A (the main apparatus) may be of a known type, and therefore, the detailed description thereof is omitted. The main apparatus comprises a fixed platen glass (an original supporting glass) 71, an original pressing plate 72, an original scanning mechanism of a movable optical system type including an original illuminating lamp, a movable mirror, an imaging lens and fixed mirrors, a rotatable photosensitive drum 74, a charger 75, a developing device 76, a transfer and separation charger 77, a cleaning device 78, first and second transfer sheet material accommodating cassettes 79 and 80, a sheet conveying device 81, an image fixing device 82, a sheet material discharging rollers 83 and a sheet material discharging outlet 70 for discharging copies.

The sorter B is provided with a plurality of bins **1*a*–1*j* which are stationary and are arranged vertically. The sorter B includes a first sheet material gripping and conveying means 2 (which will hereinafter be called "first delivering unit") which is vertically movable relative to a sheet material inlet side of each of the bins 1*a*–1*j*, and a second sheet material gripping and conveying means 4 (which hereinafter be called "second delivering unit") which functions to receive the sheet material discharged from the sheet material discharging outlet 70 of the main apparatus A and to transfer the sheet material to the first delivering unit 2, the second delivering unit 4** being vertically movable.

Figure 3:
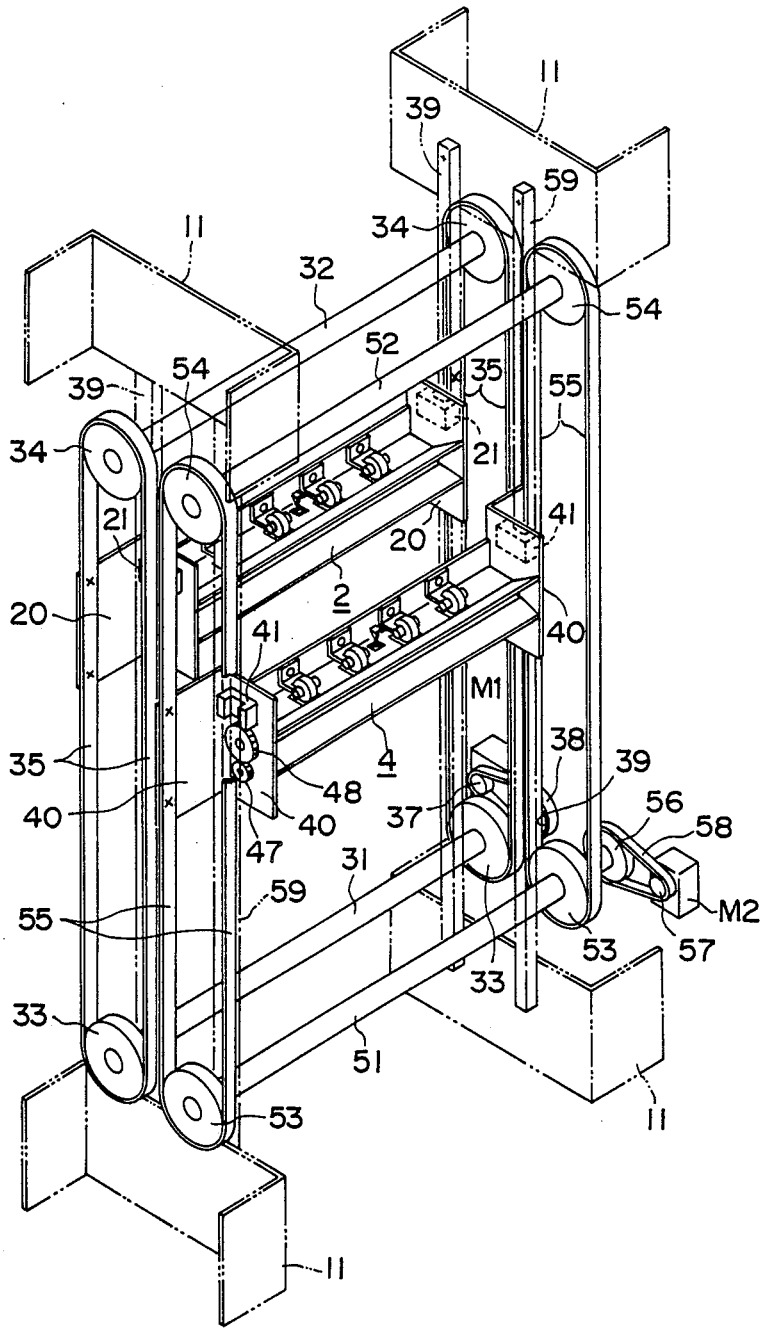
FIG. 3 is a perspective view of a vertical driving mechanism for first and second delivering units.

FIG. 3 is a perspective view of a mechanism for vertical movements of the first and second delivering units.

The vertical movement mechanism for the first delivering unit 2 includes a pair of main shafts 31 and 32 which are journalled parallel at lower and upper portions of the sorter B, pulleys 33, 33; 34, 34 mounted to the main shafts 31 and 32 at the front and rear portions, a pair of belts 35 and 35 which extend vertically at front and rear portions and which are entrained on the pulleys 33 and 34, 33 and 34, a driving pulley 36 mounted to a rear side end portion of the lower main shaft 31, a reversible motor M1 for the vertical movement, a driving pulley 37 entrained on the output shaft of the motor Ml and a belt 38 entrained on the driving pulley 37 and the pulley 36 for receiving the driving force. The first delivering unit 2 is supported on the belt 35 substantially horizontally by fixing its side plates 20 and 20 to the vertical belts 35 and 35.

When the vertical movement motor Ml is driven forwardly, the pair of belt 35 and 35 rotate forwardly by which the first delivering unit 2 moves upwardly along the sheet material inlet side of the bins **1*a*–1*j*. When, on the contrary, the motor M1 is rotated reversely, the pair of belts 35 and 35 rotate backwardly, by which the first delivering unit 2** moves downwardly.

Since the belts 35 and 35 are stretched between and entrained around the pulleys 33 and 33 fixed to the main shaft 31 at the driving side and the pulleys 34 and 34 fixed to the main shaft 32 at the follower side, the phase difference in the rotation between the belts 35 and 35 is not easily produced, and therefore, the first delivering unit 2 translates upwardly or downwardly while maintaining a horizontal position.

To the side plates 11 and 11 at the front and rear sides of the sorter C, vertical rails 39 and 39 are mounted. With the vertical rails 39 and 39, guiding members 21 and 21 mounted to the outer surfaces of the unit side plates 20 and 20 at the rear and front sides of the unit 2, are engaged, by which the unit 2 is confined in the front-rear direction and in the left-right direction when the unit moves vertically.

As for the second delivering unit 4, the moving mechanism (51–59, M2, 40, 41) is of substantially the same structure as the first delivering unit 2 in this embodiment. When the vertical movement motor M2 is rotated forwardly, a pair of belts 55 and 55 rotates forwardly, by which the second delivering unit 4 moves upwardly. When, on the contrary, the motor M2 is driven backwardly, a pair of belts 55 and 55 rotates backwardly, by which the unit 4 moves downwardly.

Figure 4A:
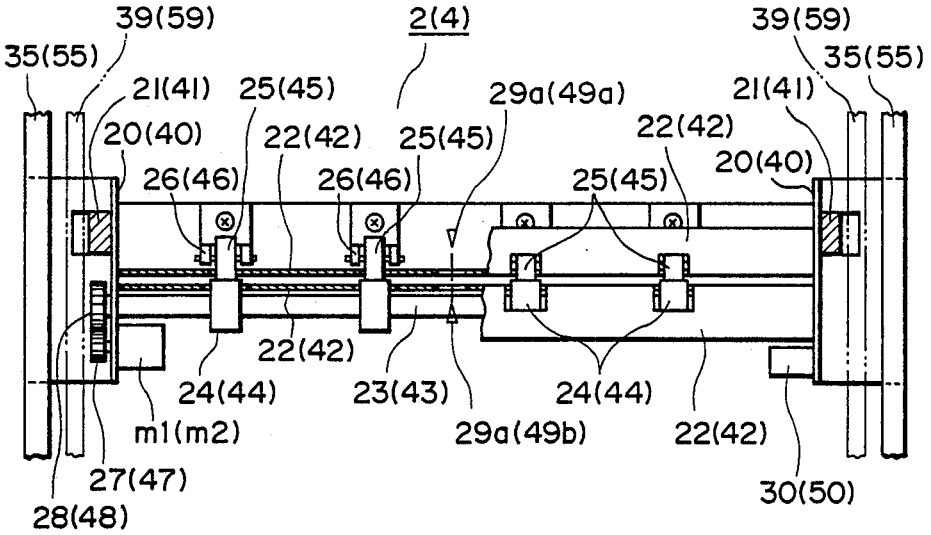
FIGS. 4A, 4B and 4C are front, left side and cross-sectional views partly broken, of a delivering unit.
Figure 4C:
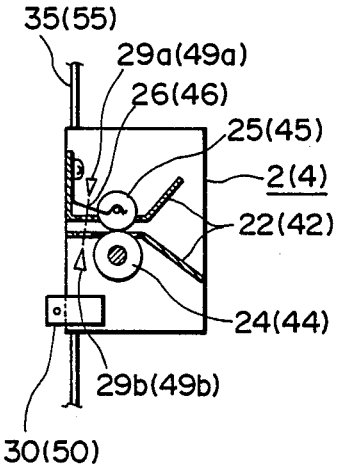
Figure 4B:
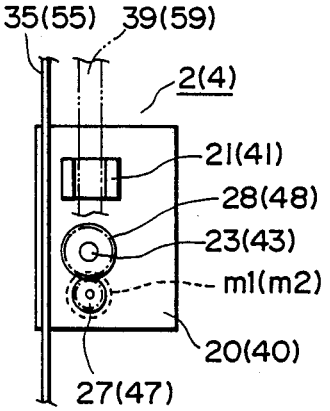

FIGS. 4A, 4B and 4C are a partly broken front view, left side view and cross-sectional view of the first delivering unit 2. In this embodiment, the second delivering unit 4 is of substantially the same structure as the first delivering unit 2, and therefore, the detailed description of the second delivering unit 4 is omitted by adding in the figures reference numerals for the second delivering unit 4 in parentheses next to the corresponding elements of the first delivering unit 2.

The first delivering unit 2 includes a couple of sheet material guiding plates 22 and 22 which are opposed vertically and which are integral with and between the unit side plates 20 and 20 at the rear and front sides, a roller shaft 23 journalled between the side plates 20 and 20, a plurality (four in this embodiment) of rollers 24 made of rubber or the like mounted to the roller shaft 23 with intervals along the length of the roller shaft 23, pressing rollers 25 press-contacted to the top sides of the rollers 24 by leaf springs 26 normally under an appropriate pressure, a sheet material conveying motor ml mounted to one of the side plates 20, a driving gear 27 mounted to the output shaft of the motor ml, a gear 28 for receiving the driving force which is mounted to a longitudinal end of the roller shaft 23 and which is meshed with the driving gear 27, a sensor 29*a* and 29*b* (a photocoupler comprising a light source and a light receiving element, for example) for detecting presence of a sheet material, the sensor being disposed at the sheet material outlet side of the sheet material guiding plates 22 and 22, and a sensor 30 (a photocoupler, for example) for detecting positions of the bins. The sensor 30 is replaced, in the second delivering unit 4, with a sensor 50 for detecting a position of the first delivering unit 2.

The nips formed between the rollers 24 and the pressing rollers 25 are disposed in a sheet material passage between the upper and lower sheet material guiding plates 22 and 22.

Figure 5A:
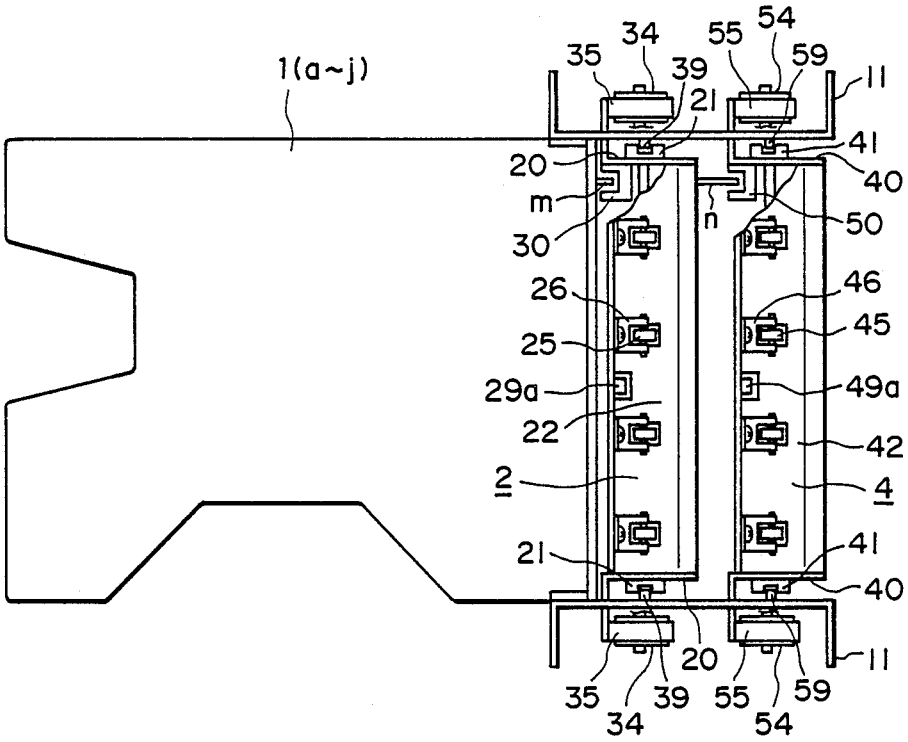
FIGS. 5A and 5B are a plan view and a sectional view partly broken in the state where the first delivering unit is opposed to a predetermined bin position, and the second delivering unit is opposed to the first delivering unit.
Figure 5B:
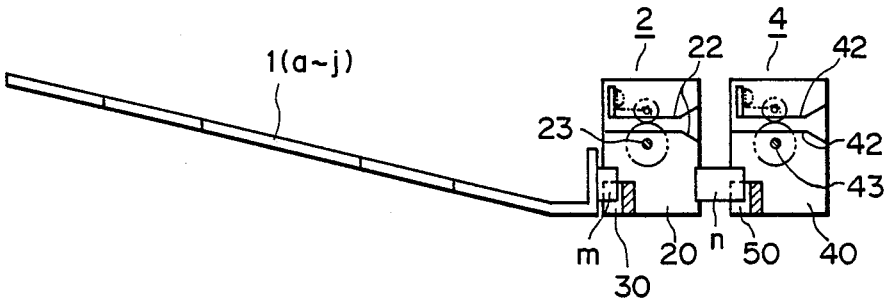

FIGS. 5A and 5B are; respectively a partly broken plan view when the first delivering unit 2 is opposed to a sheet material inlet of a predetermined one of the bins 1*a*–1*j*, and the second delivering unit 4 is opposed to the first delivering unit 2 so placed; and a sectional view thereof at the position of the sensors 30 and 50.

The first delivering unit 2 detects the position of each of the bins by counting flags M projected at the sheet material inlet sides of the bins by the sensor 30 during the upward or downward movement thereof. Therefore, the first delivering unit 2 is moved, controlled and positioned precisely at a position corresponding to each of the sheet material inlets.

The second delivering unit 4 detects by the sensor 50 the flags n projected at the first delivering unit side thereof during the upwardly or downward movement thereof, by which it is precisely moved, controlled and positioned at a position corresponding to the first delivering unit 2.

The operations of the sorter will be described in various modes.

Figure 6A:
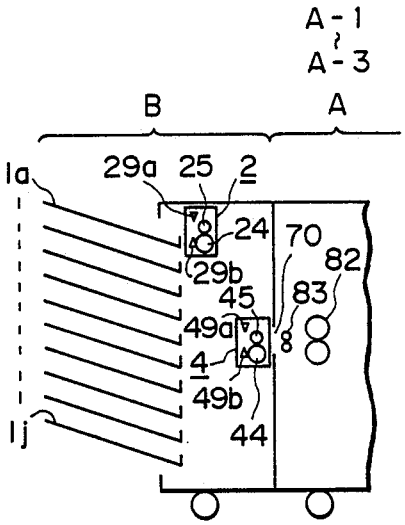
FIGS. 6A–6N illustrate an operation of the sorter.
Figure 6C:
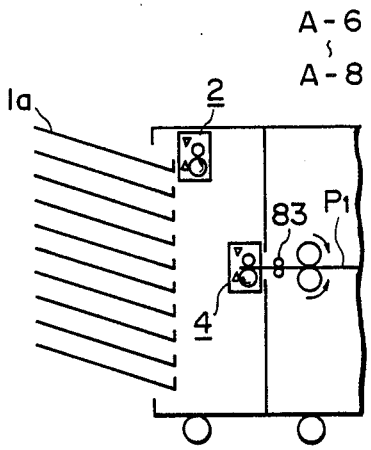
Figure 6B:
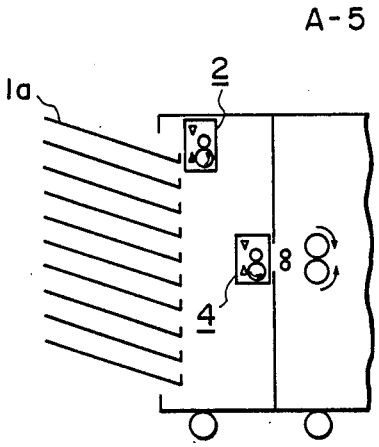
Figure 6D:
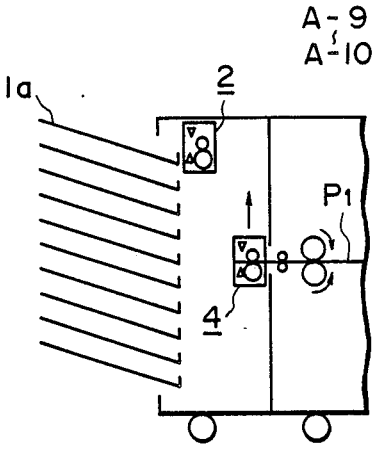
Figure 6E:
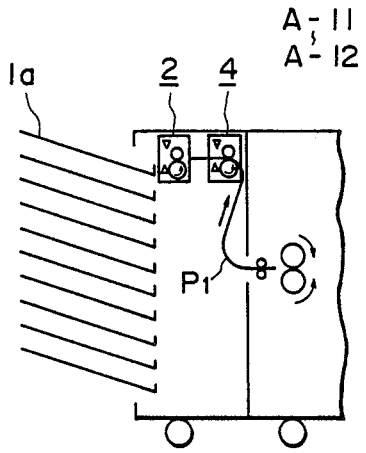
Figure 6G:
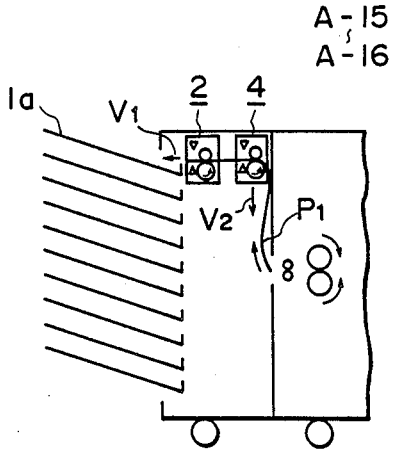
Figure 6F:
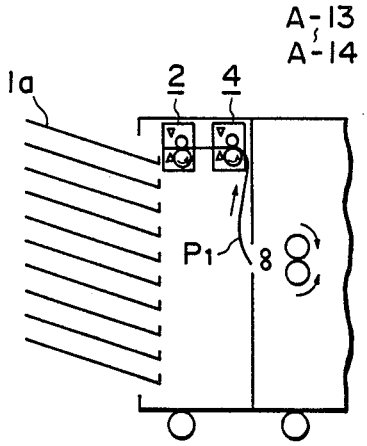
Figure 6H:
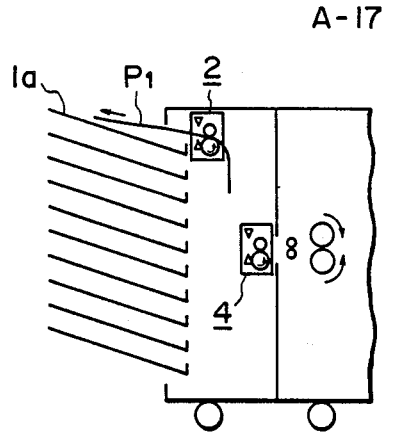
Figure 6I:
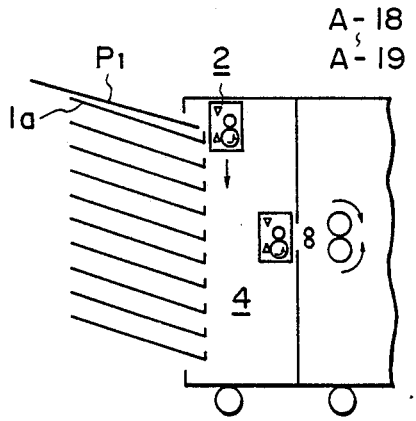
Figure 6K:
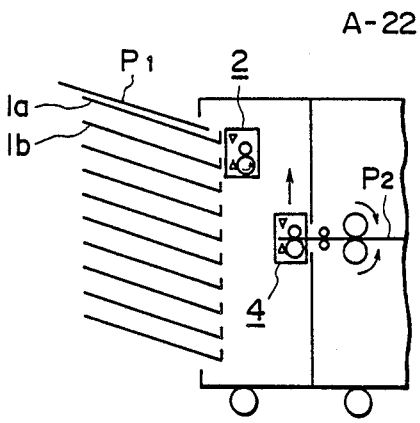
Figure 6J:
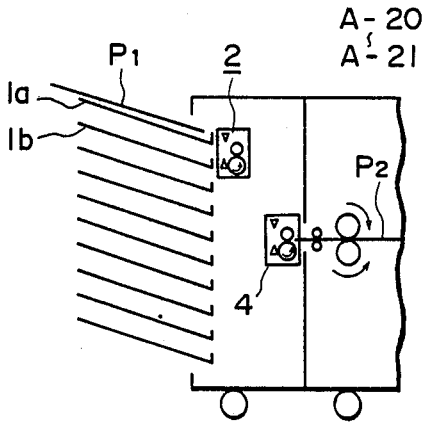
Figure 6L:
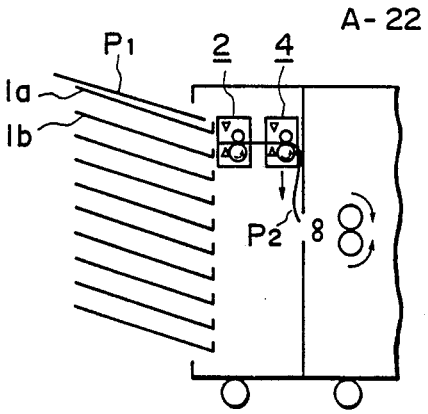
Figure 6M:
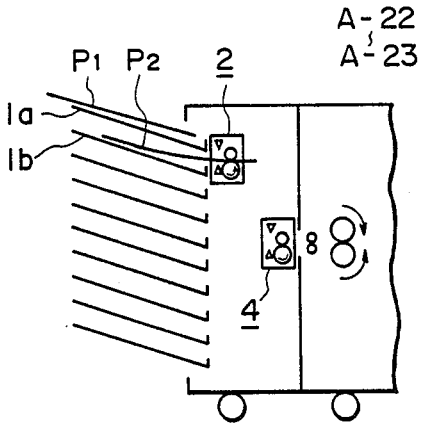
Figure 6N:
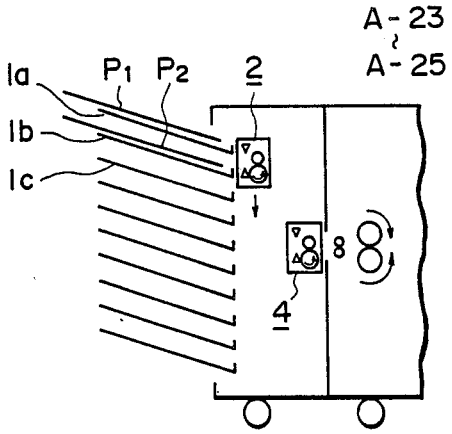

(A) Operational steps in a sorting mode (FIGS. 6A–6N)

A-1: An original is placed on the platen glass 71 of the main apparatus A (copying apparatus), and desired sorting mode conditions are set on an operation panel to input them into a control circuit. Then, a start key is depressed.

A-2: In response to the depression of the start key, the sorter B is prepared for operation (stand-by). More particularly, the discrimination is made as to (1) whether or not the first delivering unit 2 is placed at a predetermined home position which in this embodiment corresponds to the sheet material inlet of the topmost bin 1*a*, and (2) whether or not the second delivering unit 4 is placed at its home position in which it is opposed to the sheet material discharge outlet 70 of the main apparatus A. The discrimination is made by a control circuit on the basis of signals from unshown detecting means such as microswitches or the like which are actuated when the units 2 and 4 are placed at their home positions.

A-3: When one or all of the first and second delivering units 2 and 4 are not placed at the home positions, one or all of the vertical movement motors M1 and M2 (FIG. 3) are forwardly or backwardly driven to return the unit or units 2 and 4 to the home position(s) (initial setting) (FIG. 6A).

A-4: When the stand-by operation (A-1–A-3) of the sorter B is completed, the main apparatus A starts the copying operation.

A-5: Simultaneously, the sheet material conveying motors m1 and m2 (FIG. 4) of the first and second delivering units 2 and 4 are driven forwardly, by which the rollers 24 and 25 and the rollers 44 and 45 of the units 2 and 4 are rotated forwardly to be prepared for receiving the sheet material (FIG. 6B).

A-6: A first sheet material P1 having been processed for image formation in the main apparatus A is introduced into the sorter B from the discharging roller couple 83 through the discharging outlet 70.

A-7: The introduced sheet material P1 is directed to between the upper and lower guiding plates 42 and 42 of the second delivering unit 4 which is maintained at its home position opposed to the discharge outlet 70, and its leading edge is guided by the guiding plates 42 and 42 and is introduced into the nip formed between the rollers 44 and 45.

A-8: At this time, the rollers 44 and 45 are rotated in the forward direction, and therefore, the sheet material P1 is advanced forwardly between the guiding plates 42 and 42(FIG. 6C).

A-9: When the leading edge of the sheet material P1 having passed through the nip between the rollers 44 and 45 is detected by the sensors 49*a* and 49*b*, the rotation of the sheet material conveying motor m2 of the second delivering unit 4 is stopped. Therefore, the leading edge portion of the sheet material P1 is securedly gripped by the nip between the rollers 44 and 45 which are now stopped.

A-10: Simultaneously, the vertical movement motor M2 for the second delivering unit 4 is rotated forwardly to upwardly move the unit 4 while gripping the leading end portion of the sheet material P1 between the rollers 44 and 45 (FIGS. 6D–6E). That is, the sheet material P1 is conveyed upwardly. The upward movement speed of the unit 4 is substantially the same as or a little lower than the discharging speed of the sheet material P1 from the discharge outlet 70 of the main apparatus A, and therefore, the sheet material is not stretched or bent or is not imparted by an excessive load between the roller couple (44 and 45) and the discharging roller couple 83. Thus, the sheet material P1 is conveyed upwardly with a proper loop.

A-11: When the second delivering unit 4 moving upwardly reaches a position corresponding to the first delivering unit 2 placed at a position corresponding to a sheet material inlet of the topmost bin 1*a*, and its arrival is detected by the flags n and the sensor 50 (FIG. 5), the forward rotation of the upward movement motor M2 of the second delivering unit 2 is instantaneously stopped in response to the signal indicative of the arrival. That is, the upward movement of the second delivering unit 4 is stopped.

A-12: Simultaneously, the forward driving of the sheet material conveying motor m2 of the second delivering unit 4 is resumed, so that the sheet material P1 having been gripped by the nip between the rollers 44 and 45 is conveyed by the rotation of the rollers 44 and 45 to between the sheet material guiding plates 22 and 22 of the first delivering unit 2 (FIG. 6E).

A-13: The leading edge of the sheet material P1 is guided by the guiding plates 22 and 22 and is introduced into the nip formed between the rollers 24 and 25 of the first delivering unit 2. The pressure by the rollers 24 and 25 is made the same as or higher than the pressure by the rollers 44 and 45 of the secondary delivering unit 4, so that the leading edge portion of the sheet material P1 is caught by the rollers 24 and 25 with certainty.

A-14: Since the rollers 24 and 25 are already rotated forwardly, and the introduced sheet material P1 is advanced continuously in the first delivering unit 2 (FIG. 6F).

A-15: When the leading edge of the sheet material P1 which has been introduced into the first delivering unit 2 and advanced between the rollers 24 and 25 is detected by the sensors 29*a* and 29*b* for detecting the presence of the sheet material, the detecting signal starts a reverse rotation of the vertical movement motor M2 for the second delivering unit 4, so that the unit 4 starts to move downwardly. At this point of time, the leading edge of the sheet material P1 is sufficiently gripped by the nip between the rollers 24 and 25 of the first delivering unit 2, and the sheet material P1 is transferred from the second delivering unit 4 to the first delivering unit 2 with certainty.

A-16: Simultaneously, the sheet material conveying motor m2 of the second delivering unit 4 is switched to a high speed forward rotation, by which the rotational speed of the roller 44 is increased (FIG. 6G).

The high speed rotational speed $V_R$ of the roller 44, that is, the sheet conveying speed of the second delivering unit 4 during the returning movement is made substantially equal to a sum (Vl+V2) of the sheet material conveying speed Vl by the rollers 24 and 25 of the first delivering unit 2 and the lowering speed (returning speed) V2 of the second delivering unit 4. Therefore, even if the sheet material P1 is still passing through the second delivering unit 4 and is not yet completely released therefrom, the lowering movement of the unit 4 does not result in substantial load such as tension, friction or bending force or the like to the sheet material portion between the units, or the load is significantly reduced.

A-17: When the second delivering unit 4 is lowered to such an extent that it reaches its home position, that is, the position opposed to the sheet material discharging outlet 70 of the main apparatus, the backward movement of the vertical movement motor M2 is stopped, and the rotational speed of the sheet material conveying motor m2 is switched from the high rotational speed to the normal speed, and it waits for the next sheet material from the main apparatus A (FIG. 6H).

By the time when the second delivering unit 4 is completely returned to its home position, the trailing edge of the sheet material P1 transferred to the first delivering unit 2 has been completely released from the second delivering unit 4.

The returning speed V2 of the second delivering unit 4 to its home position is preferably as high as possible, because the next sheet material can be received not in haste, so that the conveyance can be performed securely.

A-18: On the other hand, the sheet material P1 transferred to the first delivering unit 2 is discharged onto the topmost bin la to which the unit 2 is opposed, by the forward rotation of the rollers 24 and 25 of the first delivering unit 2.

A-19: When it is detected that the sheet material P1 is discharged onto the bin la by the passage of the trailing edge of the sheet material by the sensors 29*a* and 29*b*, the vertical movement motor M1 of the first delivering unit is rotated backwardly, so that the lowering movement of the unit 2 starts (FIG. 6I). The lowering speed of the unit 2 is preferably as high as possible.

A-20: When the arrival of the first delivering unit 2 moving downwardly at a position corresponding to the sheet material inlet of the next stage bin 1*b*, is detected by the flag m and the sensor 30 (FIG. 5), the backward movement of the vertical movement motor M1 is stopped instantaneously, and the unit 4 is retained at a position corresponding to the sheet material inlet of the next bin 1*b* (FIG. 6J).

A-21: A second sheet P2 is discharged from the main apparatus A and is introduced into the sorter B.

A-22: The operational steps A7–A17 are performed (FIG. 6K–6M).

A-23: The second sheet material P2 is discharged onto the second bin lb since the first delivering unit 2 is opposed to the second bin 1*b* counted from the top.

A-24: When the sensors 29*a* and 29*b* detect that the second sheet material is discharged onto the bin 1*b*, the first delivering unit 2 is moved downwardly in the similar manner as described with the step A-19 (FIG. 6N).

A-25: Similarly to the step A-20, the first delivering unit 2 is moved to and is retained at the position where it is opposed to the sheet material inlet of the third bin 1*c* which is the next bin.

By repeating the above described operational steps, the sheet materials are sequentially distributed or sorted to the plural bins.

When, for example, 10 sets of copy sheets, each having three pages, are to be sorted, the copy sheets from the first original are first distributed in the manner described above to bins 1*a*–1*j* (from the first bin to the tenth bin). Next, the copy sheets from the second original are distributed to bins 1*j*–1*a* (from the tenth bin to the first bin), that is, in the reverse order. For the copy sheets from the third original are distributed in the order from the first bin 1*a* to the tenth bin 1*j*. By doing so, the sorting operation is performed efficiently.

(B) Group (collation mode)

B-1: The stand-by operation is performed in the similar manner as described with operational steps A-1–A-3.

B-2: By the operations similar to the above described steps A-5–A-18 in the sorting mode, the first discharged sheet material is discharged to the topmost bin 1*a* from the main apparatus A.

B-3: Even after the first sheet material is discharged onto the bin 1*a*, the first delivering unit 2 is retained at the bin 1*a* position, and it waits for the second and subsequent sheet materials from the main apparatus A.

B-4: A predetermined number of second and subsequent sheet materials discharged from the main apparatus A are discharged onto the topmost bin la by repeating the operational steps A-5–A-18.

B-5: When the predetermined number of copying operations are completed, and the resultant copy sheets are discharged onto the topmost bin 1a, and the start key of the main apparatus A is depressed again, the vertical movement motor M1 of the first delivering unit 2 is rotated reversely to lower the first delivering unit 2.

B-6: The first delivering unit, similarly to the step A-20, is stopped at a position where it is opposed to the sheet material inlet of the second bin **1*b***.

B-7: To the second bin **1*b***, the predetermined number of the copy sheets discharged from the main apparatus A are sequentially discharged by repeating the operational steps A-7–A-17 and A-23.

B-8: When the start key of the main apparatus A is further depressed, the first delivering unit 2 is lowered to the sheet material inlet of the third bin **1*c* counted from the top, and in the similar manner described above, the predetermined number of sheet materials are discharged onto the bin 1*c***.

In this manner, each time the start key of the main apparatus A is depressed, the first delivering unit 2 is lowered by the amount corresponding to one stage of the bins. Thus, the sheet materials can be distributed in the collation mode for each of the bins down to the bottommost bin **1*j***.

(C) Non-sorting mode

C-1: The stand-by operation is performed in the similar manner as described with steps A-1–A-3 in the sorting mode.

C-2: The operations A-5–A-18 in the sorting mode and B-3 and B-4 in the collation mode, are repeated, by which all the sheet materials discharged from the main apparatus A are discharged onto the topmost bin **1*a***.

The sheet material conveying speed of the first and second delivering units 2 and 4 is preferably near the discharging speed of the sheet material from the main apparatus A, from the standpoint of not imparting load to the sheet material.

When the sensors **49*a* and 49*b* sheet detect that the sheet material is passed through the second delivering unit 4, the sheet material conveying speed of the first delivering unit 2 may be increased. Additionally, passage of the trailing edge of the sheet material through the image fixing device 82 or through the discharging roller couple 83 in the main apparatus A may be detected by a sensor S1 (FIG. 2) in the main apparatus A, and in response to which the sheet conveying speed of the first and second delivering units 2 and 4** of the sorter B may be increased.

(D) Random access mode

D-1. The stand-by operation is performed in the similar manner as with A-1–A-3 in the sorting mode.

D-2: When, for example, it is instructed from the main apparatus A, that the first sheet material is to be discharged to the topmost bin 1a, the operation of steps A-5–A-18 in the sorting mode is executed, so that the first sheet material is discharged to the topmost bin 1a.

D-3: The main apparatus A instructs that the second sheet material is discharged onto the bottommost bin tray **1*j*, for example. The bottommost bin 1*j* is taken as an example, and may be any one of the bins 1*a* –1*j***.

D-4: The sensors **29*a* and 29-*b* of the first delivering unit 2 detect that the first sheet material is discharged to the topmost bin 1*a* and the vertical movement motor M1 of the first delivering unit 2 is rotated backwardly, so that the unit 2 lowers immediately toward the bin 1*j***.

D-5: When the arrival of the first delivering unit 2 to the sheet material inlet of the instructed bin **1*j*, is detected by the flag n and the sensor 30, the motor M1 is stopped so that the unit 2 is stopped at the position corresponding to the bin 1*j***, and it waits for the next, i.e., the second sheet material.

D-6: On the other hand, the second delivering unit 4 is returned to its home position corresponding to the sheet material discharge outlet 70 of the main apparatus A, by the operation A-17 in the sorting mode, and it waits for the second sheet material to be discharged.

D-7: When the second sheet material is discharged from the main apparatus A, the operations A-7–A-17 in the sorting mode are executed.

D-8: Since the first delivering unit 2 is retained at a position corresponding to the bottommost bin **1*j* the second sheet material is discharged onto the bin 1*j* by the unit 2**.

D-9: When the sensors **29*a* and 29*b* of the first delivering unit 2 detects that the second sheet material is discharged onto the bin 1*j*, the first delivering unit 2 is moved toward the next instructed bin position (one of bins 1*a*–1*j***).

By repeating the above operations, the sheet materials are distributed in accordance with the instructions from the main apparatus A for each of the sheet materials (random mode). In this mode, the time period required for the sheet material to be transferred from the second delivering unit 4 to the first delivering units 2 can be spent for the movement of the first delivering unit 2 to the next bin, and therefore, the amount of movement of the delivering unit can be increased as compared with the conventional machines, and therefore, it is made possible that the intervals between adjacent bins can be increased to increase the sheet stacking capacity of each of the bins, or it is made possible to increase the total number of bins.

Another embodiment of the present invention will be described in conjunction with FIGS. 7A and 7B. As for a measure for reducing the load to the sheet material during the returning stroke of the second delivering unit 4 to the home position from the position of the first delivering unit 2 to which the second delivering unit 4 has transferred the sheet material, it is effective to release the sheet material gripping and conveying force of the unit 4 during the returning stroke of the unit 4.

Figure 7A:
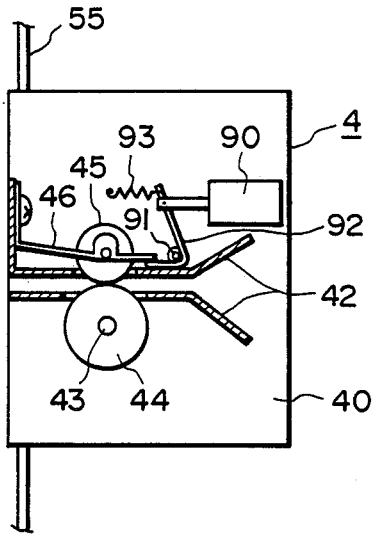
FIGS. 7A and 7B show an example for releasing a sheet in the second delivering unit in another embodiment of the present invention.
Figure 7B:
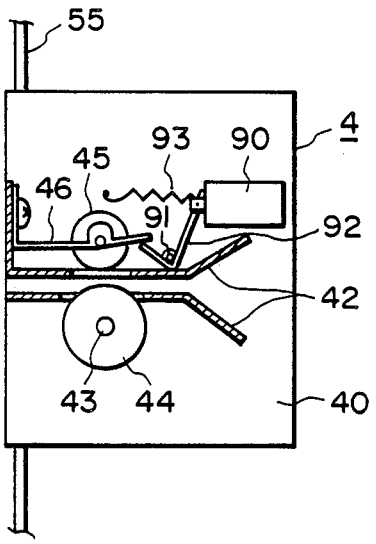

FIGS. 7A and 7B illustrate an example of a mechanism for effecting such releasing. The second delivering unit 4 is provided with a lever 92 swingably controlled about a shaft 91 by a solenoid-plunger 90. The free end of the lever 92 is engaged with a leaf spring 46 for press-contacting the roller 45 to the roller 44. There is provided a lever resetting spring 93.

When the solenoid 90 is not energized, the lever 92 is rotated in the clockwise direction about the shaft 91 by the resetting spring 93 so that it does not lift the leaf spring 46, and therefore, the roller 45 is maintained by the leaf spring 46 at a sheet material gripping and conveying position wherein the roller 45 is sufficiently press-contacted to the top surface of the roller 44, as shown in FIG. 7A.

When the solenoid 90 is energized, as shown in FIG. 7B, the lever 92 is rotated clockwisely about the shaft 91 against the spring force 93. By this, the leaf spring 46 is lifted so that the roller 45 is separated from the top surface of the roller 44 and is spaced from the roller 44, that is, the sheet material gripping and conveying force is disabled.

When the second delivering unit 4 is in the returning stroke, the solenoid 90 is energized to release the sheet material from the sheet material gripping and conveying force of the unit 4. When the unit 4 reaches the home position, the solenoid 90 is deenergized, so that the sheet gripping and conveying force is reset.

A third embodiment will be described.

The feature of the third embodiment resides in the fact that the second delivering unit 4 is reciprocated only between its home position and the home position of the first delivering unit 2, so that the reciprocating stroke is constant, and by properly setting the home position of the first delivering unit, the reciprocating stroke can be relatively short.

The position where the first delivering unit 2 receives the sheet material from the second delivering unit 4, is always constant.

The operational step of this example will be explained. Here, the portions of description that are the same as the case of FIGS. 6A–6N are omitted.

Figure 8A:
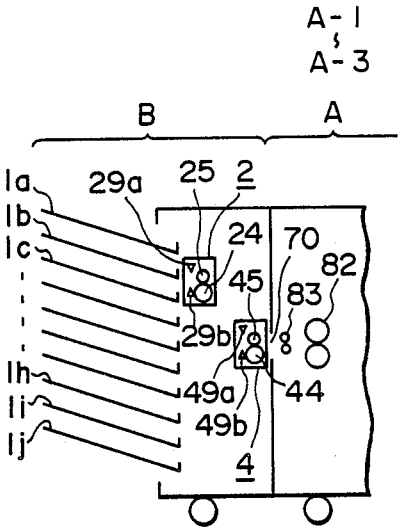
FIGS. 8A–8O illustrate an operation of a sorter according to a further embodiment of the invention.

(A) Operational steps in a sorting mode (FIG. 8A–80)

A-1: A start key is depressed.

A-2: In response to the depression of the start key, the sorter B is prepared for operation (stand-by). More particularly, the discrimination is made as to (1) whether or not the first delivering unit 2 is placed at a predetermined home position which in this embodiment corresponds to the position of the third bin 1*c* as counted from the top which is substantially at the middle between the topmost bin 1a and the sheet discharging outlet of the main apparatus A, and (2) whether or not the second delivering unit 4 is placed at its home position in which it is opposed to the sheet material discharge outlet 70 of the main apparatus A. The discrimination is made by a control circuit on the basis of signals from unshown detecting means such as microswitches or the like which are actuated when the units 2 and 4 are placed at their home positions.

A-3: When one or all of the first and second delivering units 2 and 4 are not placed at the home positions, one or all of the vertical movement motors M1 and M2 (FIG. 3) are forwardly or backwardly driven to return the unit or units 2 and 4 to the home position(s) (initial setting) (FIG. 8A).

A-4: When the stand-by operation (A-1–A-3) of the sorter B is completed, the main apparatus A starts the copying operation.

Figure 8C:
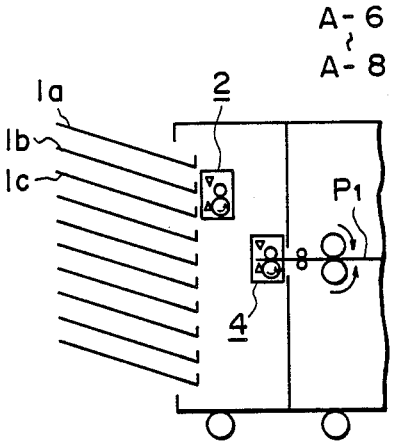
Figure 8B:
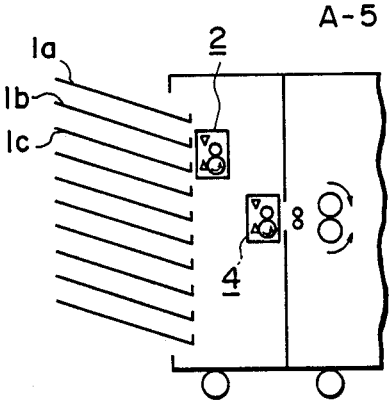

A-5: Simultaneously, the sheet material conveying motors m1 and m2 (FIG. 4) of the first and second delivering units 2 and 4 are driven forwardly, by which the rollers 24 and 25 and the rollers 44 and 45 of the units 2 and 4 are rotated forwardly to be prepared for receiving the sheet material (FIG. 8B).

A-6: A first sheet material P1 having been processed for image formation in the main apparatus A is introduced into the sorter B from the discharging roller couple 83 through the discharging outlet 70.

A-7: The introduced sheet material P1 is directed to between the upper and lower guiding plates 42 and 42 of the second delivering unit 4 which is maintained at its home position opposed to the discharge outlet 70, and its leading edge is guided by the guiding plates 42 and 42 and is introduced into the nip formed between the rollers 44 and 45.

A-8: At this time, the rollers 44 and 45 are rotated in the forward direction, and therefore, the sheet material P1 is advanced forwardly between the guiding plates 42 and 42 (FIG. 8C).

A-9: When the leading edge of the sheet material P1 having passed through the nip between the rollers 44 and 45 is detected by the sensors 49*a* and 49*b*, the rotation of the sheet material conveying motor m2 of the second delivering unit 4 is stopped.

Figure 8D:
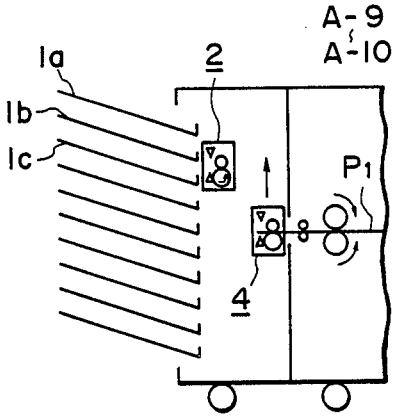

A-10: Simultaneously, the vertical movement motor M2 for the second delivering unit 4 is rotated forwardly to upwardly move the unit 4 while gripping the leading end portion of the sheet material P1 between the rollers 44 and 45 (FIG. 8D). That is, the sheet material P1 is conveyed upwardly.

A-11: When the second delivering unit 4 moving upwardly reaches a position corresponding to the first delivering unit 2 placed at the home position corresponding to a sheet material inlet of the third bin 1*c*, and the reaching is detected by the flags n and the sensor 50 (FIG. 5), the forward rotation of the upward movement motor M2 of the second delivering unit 2 is instantaneously stopped in response to the signal indicative of the arrival. That is, the upward movement of the second delivering unit 4 is stopped.

A-12: Simultaneously, the forward driving of the sheet material conveying motor m2 of the second delivering unit 4 is resumed, so that the sheet material P1 having been gripped by the nip between the rollers 44 and 45 is conveyed by the rotation of the rollers 44 and 45 to between the sheet material guiding plates 22 and 22 of the first delivering unit 2.

A-13: The leading edge of the sheet material P1 is guided by the guiding plates 22 and 22 and is introduced into the nip formed between the rollers 24 and 25 of the first delivering unit 2.

Figure 8E:
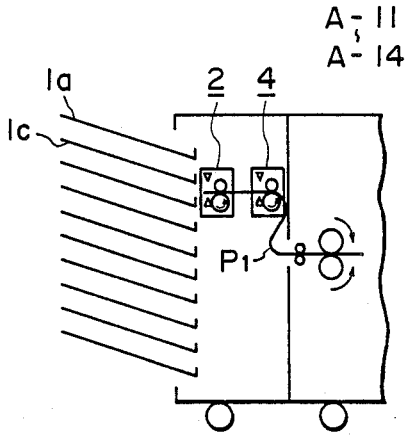

A-14: Since the rollers 24 and 25 are already rotated forwardly, the introduced sheet material P1 is advanced continuously in the first delivering unit 2 (FIG. 8E).

A-15: When the leading edge of the sheet material P1 which has been introduced into the first delivering unit 2 and advanced between the rollers 24 and 25 is detected by the sensors 29*a* and 29*b* for detecting the presence of the sheet material, the detecting signal stops the forward rotation of the sheet material conveying motor m of the first delivering unit 2, and the leading edge portion of the sheet material P1 is securedly gripped by the nip between the rollers 24 and 25 and is retained there.

A-16: Simultaneously, the vertical movement motor M1 for the first delivering unit 2 is rotated forwardly, by which the unit 2 moves upwardly while gripping the leading edge portion of the sheet material P1 by the nip between the rollers 24 and 25. The upward movement speed of the unit 2 is the same or a little lower than the discharging speed of the sheet material P from the main apparatus A.

A-17: Simultaneously, the vertical movement motor M2 of the second delivering unit 4 is rotated backwardly, so that the lowering movement of the unit 4 starts. At this point of time, the leading edge of the sheet material P1 has been sufficiently gripped by the nip between the rollers 24 and 25 of the first delivering unit 2, and therefore, the sheet transfer from the second delivering unit 4 to the first delivering unit 2 is performed with certainty.

A-18: Simultaneously, the sheet material conveying motor m2 of the second delivering unit 4 is switched to a high speed forward rotation, that is, the rotational speed of the roller 44 is increased.

Figure 8G:
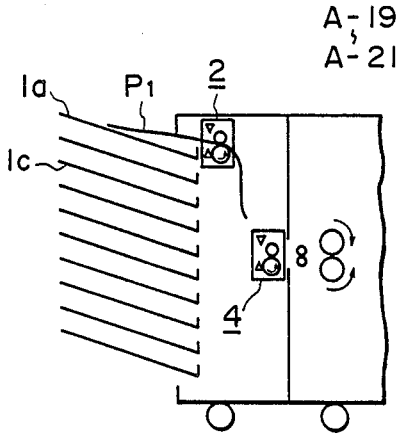
Figure 8F:
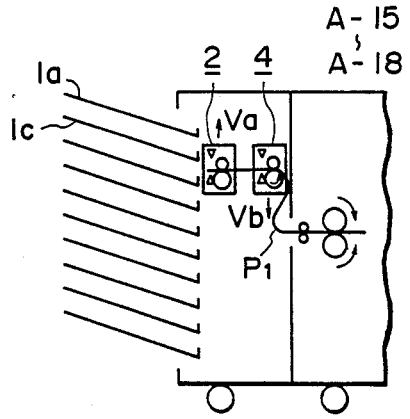

The sheet conveying speed $V_R$ of the unit 4 during the returning stroke of the second delivering unit 4 is made substantially equal to a sum (Va+Vb) of a moving speed Va of the first delivering unit 2 and the returning speed Vb of the second delivering unit 4. Therefore, even if the unit 4 is lowered while the sheet material P1 has not been passed through the second delivering unit 4, the portion of the sheet material between the units 2 and 4 is not imparted with substantial load such as tension, friction or bending force or the like. Or, the load is significantly reduced (FIG. 8F).

A-19: The arrival of the first delivering unit 2 to a position corresponding to the sheet material inlet of the topmost bin 1*a* is detected by the flag m and the sensor 30, the forward rotation of the vertical movement motor M1 is instantaneously stopped to stop the upward movement of the unit 2.

A-20: Simultaneously with the stoppage of the vertical movement motor M1, the forward rotation of the sheet material conveying motor ml is resumed, by which the sheet material P1 is started to be discharged from the first delivering unit 2 to the topmost bin 1*a* to which it is currently opposed. With this state, if the second delivering unit 4 is not completely returned to its home position where it is opposed to the sheet material discharge outlet 70 of the main apparatus A, and the sheet material P is still passing through the nip between the rollers 44 and 45 of the unit 4, the possible load to the portion of the sheet material P1 between the units 2 and 4 is reduced by making the sheet material conveying speed by the roller 44 driven by the sheet material conveying motor M2 substantially equal the sum of a sheet material conveying speed of the first delivering unit 2 and the returning speed of the second delivering unit 4.

A-21: When the second delivering unit 4 reaches a position corresponding to the sheet material discharge outlet 70 of the main apparatus, that is, its home position, the backward rotation of the vertical movement motor M2 is stopped, and the rotational speed of the sheet material conveying motor m2 is switched to the normal speed, and it waits for the next sheet material to be discharged from the main apparatus A (FIG. 8G).

By the time the second delivering unit 4 is completely returned to its home position, the trailing edge of the sheet material P1 transferred to the first delivering unit 2 has been completely released from the second delivering unit 4.

A-22: On the other hand, the sheet material P1 transferred to the first delivering unit 2 is discharged to the topmost bin la to which the unit 2 is opposed, by the forward rotation of the rollers 24 and 25 of the unit 2.

Figure 8H:
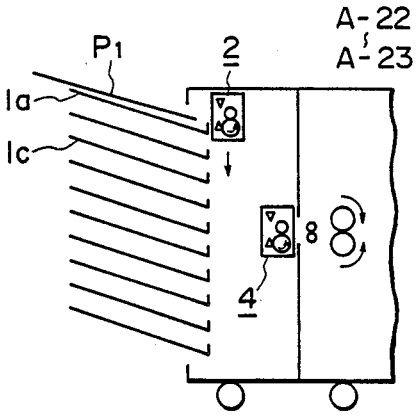

A-23: The discharge of the sheet material P1 onto the bin 1*a* is detected by the passage of the trailing edge of the sheet material by the sensors 29*a* and 29*b*, the vertical movement motor M1 of the first delivering unit 2 is rotated backwardly, so that the unit 2 is returned to its home position where it is opposed to the third bin 1*c*, counted from the top (FIG. 8H).

Figure 8I:
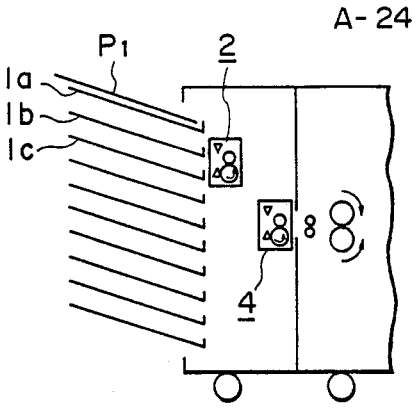

A-24: When the home position sensor detects that the first delivering unit 2 returned to the bin 1*c* position, the backward rotation of the vertical movement motor M1 is instantaneously stopped, and the unit 4 is retained at the bin 1*c* position (FIG. 8I).

A-25: A second sheet material P2 is discharged from the main apparatus A to the sorter B.

Figure 8K:
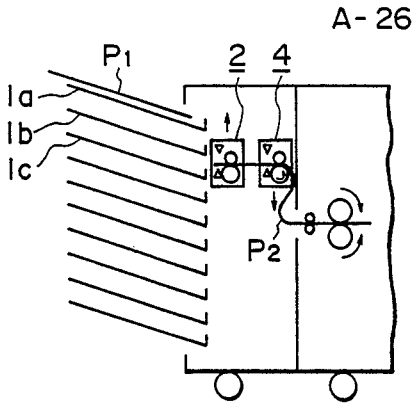
Figure 8J:
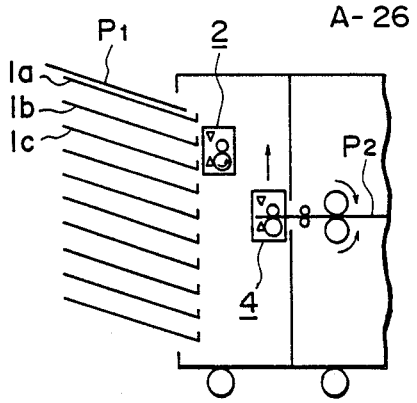
Figure 8L:
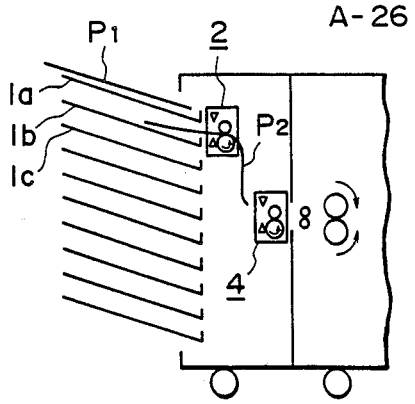

A-26: The operations A-7–A-18 are repeated (FIG. 8J–8L).

Figure 8M:
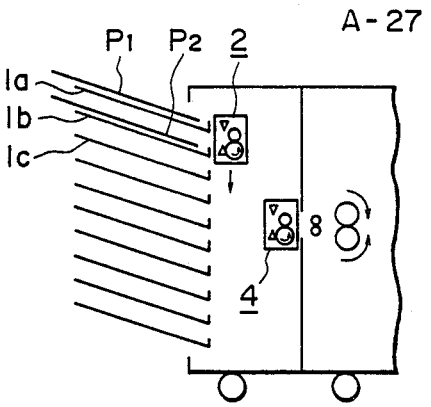
Figure 8O:
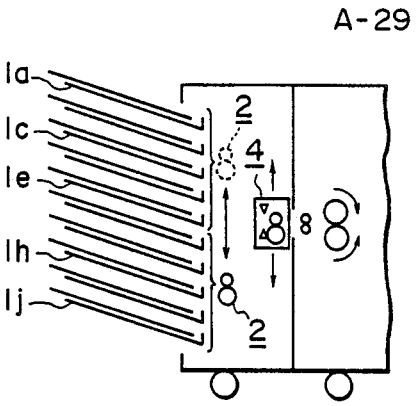

A-27: The second sheet P2 transferred from the first delivering unit 2 is transported to the second bin 1b by the delivering unit 2 (FIG. 8M). When the sheet is discharged to the third bin 1*c*, the first delivering unit 2 is maintained at the home position. However, when the sheet is discharged to fourth or fifth bin 1*d* or 1*e*, it lowers.

In this case, the first unit 2 and the second unit 4 are temporarily lowered in the same direction, and therefore, the roller 44 of the unit 4 may be maintained non-rotating. The pressure by the rollers 44 and 45 may be disabled.

Figure 8N:
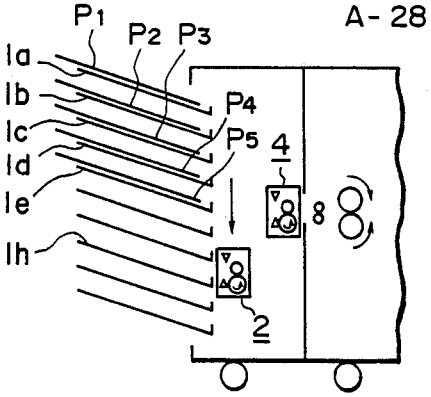

A-28: When the similar operations are repeated to an extent of the bin le (top five bins), the first delivering unit 2 is shifted to a second home position which is, in this embodiment, the eighth bin 1h as counted from the top (the third bin from the bottom) (FIG. 8N).

A-29: By the similar operations, the sheet materials are discharged sequentially to the bins 1*f*–1*j* (the bottom five bins) (FIG. 80). For the bins 1*f* and 1*g*, the unit 2 moves upwardly, and for the bins i and j, the unit 2 is lowered.

Thus, the second delivering unit 4 has its home position which corresponds to the sheet material discharge outlet 70 of the main apparatus and shares the sheet material transportation from the home position to the first home position (bin 1*c* position) of the first delivering unit or to the second home position (bin 1*h* position) of the first delivering unit 2. The first delivering unit 2 shares the sheet material transportation from its first home position to the top five bins 1*a*–1*e* and the sheet material transportation from the second home position to the bottom five bins 1*f*–1*j*.

By repeating the above described operations, the sheet materials are sequentially sorted to the plural bins.

When, for example, 10 sets of copies are to be produced from three page originals, the copy sheets from the first original are distributed sequentially to the bins 1*a*–1*j* (from the first bin to the tenth bin) in this order. Then, the copy sheets from the second original are distributed to the bins 1*j*–1*a* (from the tenth bin to the first bin), that is, in the reversed order. For the copy sheets from the third original, the sheets are again distributed to bins 1*a*–1*j* in this order. By doing so, the sorting operation is performed efficiently.

(B) Group (collation) mode

B-1: The stand-by operation is performed in the similar manner as with operations A-1–A-3 in the sorting mode.

B-2: The same operation as with operations A-5–A-25 in the above-described sorting mode are executed.

B-3: For the subsequent sheet materials, the operations A-5–A-25 are performed, so that the sheet materials are discharged on the bin 1*a*. The operation is repeated for a preset number.

B-4: The operations A-5–A-25 are performed for the subsequent sheets so that the sheet materials are discharged on the bin 1*a*. The operations are repeated for a preset number of sheet materials.

B-5: When the copying operation for a preset number is completed, and next, the copy start key is depressed again, the vertical movement motor M1 for the first delivering unit is rotated backwardly, so that the unit 2 lowers.

B-6: Similarly to A-27, it is retained at a position corresponding to the bin 1*b*.

B-7: The preset number of sheet materials are distributed to the bin 1*b*.

B-8: When the copy start key is depressed further again, the delivering unit 2 is lowered to the position corresponding to the bin 1*c*, and by repeating this, the sheet materials can be distributed up to the bin 1*j*.

(C) Non-sorting mode

C-1: The stand-by operation is performed in the similar manner as with A-1–A-3 in the sorting mode.

C-2: The operations A5–A25 are performed, so that all the sheet materials discharged from the main apparatus A are discharged to the bin 1*a*.

Here, the forward conveying speeds of the first and second delivering units 2 and 4 are preferably close to the sheet discharging speed from the main apparatus A from the standpoint of not imparting load to the sheet material.

Figure 9:
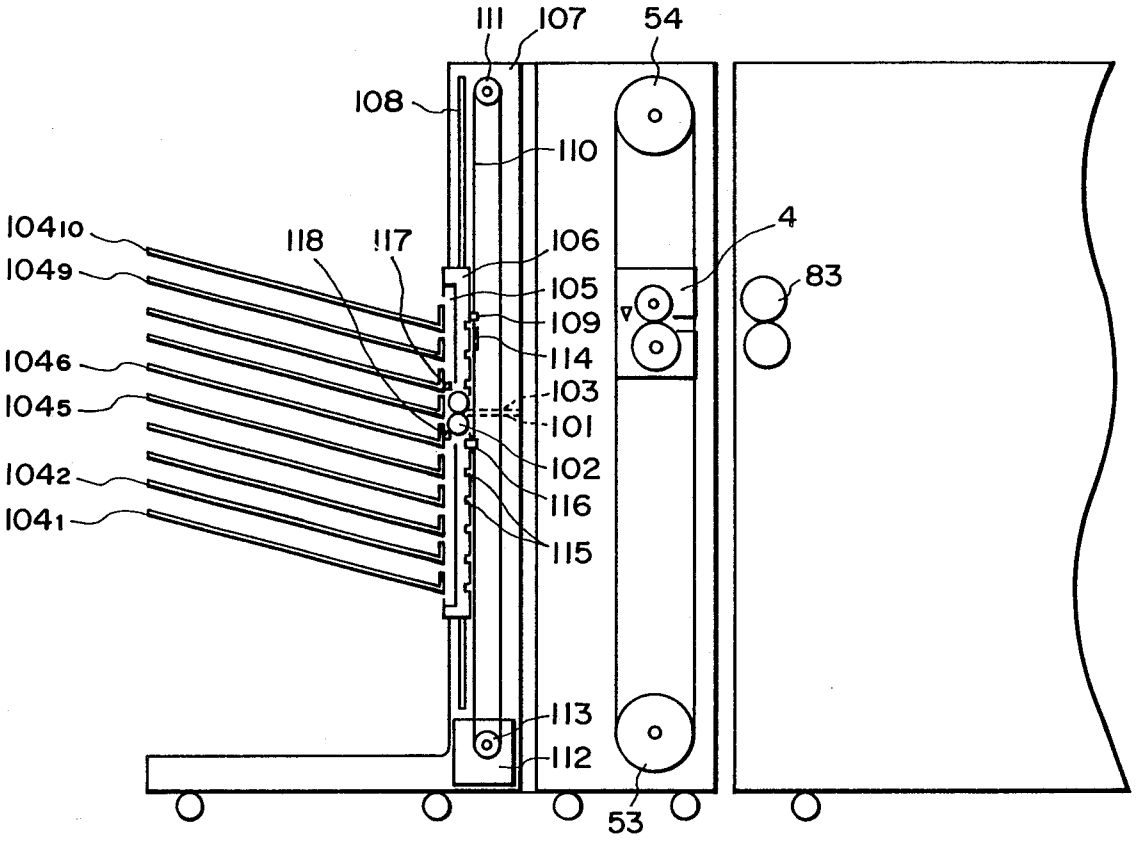
FIG. 9 is a sectional view of a sorter according to a further embodiment of the present invention.
Figure 10:
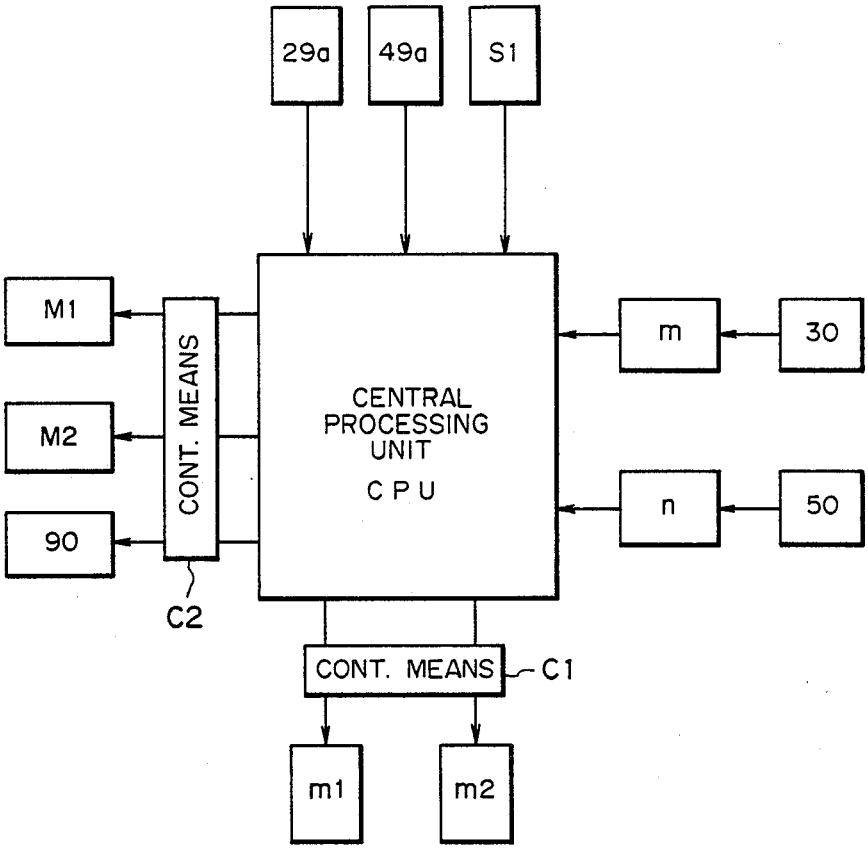
FIG. 10 is a block diagram for the sorter of FIG. 9.

Referring to FIG. 9, a further embodiment of the present invention will be described, wherein a couple of rollers 102 and 103 corresponding to the first delivering unit is stationary, and instead, the bins $\mathbf{104}_1$–$\mathbf{104}_{10}$ are vertically movable. Construction and operation of the second delivering unit 4 are the same as with FIG. 2. The pressure may be disabled as in FIG. 7 embodiment. In FIG. 9, trays $\mathbf{104}_1$, $\mathbf{104}_2$ . . . $\mathbf{104}_9$ and $\mathbf{104}_{10}$ are fixedly mounted to a tray frame 105, and the tray frame 105 is stationary mounted to a vertically movable member 106. The vertically movable member 106 is vertically movable through a distance corresponding to the distance from the tray $\mathbf{104}_1$ to tray $\mathbf{104}_{10}$ along a guiding groove 108 of a post 107. To a top end of a chain receiving member 109 fixedly mounted to the vertically movable member 106, a chain (or wire or the like) 110 is fixedly mounted, and chain is reflected by an idler 111 disposed at an upper portion. The chain is extended to a sprocket 113 mounted to an end of a shaft of the motor 112 at a lower portion. Another end of the chain 110 is fixedly mounted through a spring 114 to a bottom end of the chain receiving member 9. Therefore, when the motor 112 is rotated in the clockwise direction, the trays $\mathbf{104}_1$–$\mathbf{104}_{10}$ are moved upwardly as a unit.

The operation will be described. For an initial setting, the motor 12 is rotated clockwisely, by which the trays $\mathbf{104}_1$–$\mathbf{104}_{10}$ are moved to their topmost positions. When a position detecting sensor 116 detects that the sheet inlet of the tray $\mathbf{104}_1$ is aligned with a nip formed between the movable rollers 102 and 103, the current supply to the motor 112 is switched by a proper control circuit from a driving AC voltage to a stopping DC voltage, so that they are substantially positionally aligned.

Subsequently, the sheet is introduced, and the sheet detecting sensors 117 and 118 detect that the sheet is accommodated on the tray $\mathbf{104}_1$ by the movable rollers 102 and 103. Then, the motor 112 is supplied with a braking DC voltage which is lower than the stopping DC voltage described above, by which the trays are allowed to fall by gravity. The same operation is possible using a flexible member such as a spring in place of gravity. When a notch 115 corresponding to the tray $\mathbf{104}_2$ is detected by the position sensor 116, the voltage supplied to the motor 112 is switched to the stopping DC voltage, by which the trays are stopped, so that the sorter is now in the position for receiving the sheet in the tray $\mathbf{104}_2$. The sheet sorting and stacking operations are repeated the required number of times, and thereafter, the initial state is restored by a resetting signal.

The transfer of the sheet material discharged from the roller 83 to the rollers 102 and 103, the sheet material gripping and conveying means 4 is used in the same manner as described above. The detection of the sheet material being gripped by the rollers 102 and 103 is performed by the sensors 118 and 117. In response to a signal from the sensors, the sheet material gripping and conveying means 4 stops the sheet conveying operation, and it moves upwardly to the home position.

According to this embodiment, the sorter can be designed flexibly without being limited by the height of the sheet outlet of the copying machine or the like, that is, the level of the roller 83. In the structure of this embodiment, jamming occurs less frequently than in a structure wherein a guiding passage is used for connecting the roller 83 and the rollers 102 and 103.

While the invention has been described with reference to the structures disclosed herein, it is not confined to the details set forth and this application is intended to cover such modifications or changes as may come within the purposes of the improvements or the scope of the following claims.

What is claimed is:

1. A sheet material distributing apparatus, comprising:

a plurality of bins for accommodating sheet materials, each of said bins having a sheet material inlet;

a first sheet material gripping and conveying means movable to be opposed to the sheet material inlet of each of said bins;

second sheet material gripping and conveying means linearly movable to receive one of the sheet materials from a sheet material discharging device to transfer the sheet material to said first sheet material gripping and conveying means.

2. An apparatus according to claim 1, further comprising a pressure releasing mechanism for removing a sheet material gripping force of said second sheet material gripping and conveying means before it returns to a position for receiving the sheet material from the sheet material discharging device.

3. An apparatus according to claim 1, further comprising means for controlling a conveyed speed $V_R$ of said second sheet material gripping and conveying means to be V1+V2 during a period when said second sheet material gripping and conveying means returns to a position for receiving the sheet material from the sheet material discharging device, where V1 is a sheet material conveying speed of said first sheet material gripping and conveying means, and V2 is a returning speed of said second sheet material gripping and conveying means.

4. An apparatus according to claim 1, further comprising control means for controlling said first sheet material gripping and conveying means to move stepwisely in correspondence with said bins and in correspondence with a position where said first sheet material gripping and conveying means receives the sheet material from said second sheet material gripping and conveying means.

5. An apparatus according to claim 1, further comprising control means for controlling movement of said first sheet material gripping and conveying means so that a position where said first sheet material gripping and conveying means receives the sheet material from said second sheet material gripping and conveying means is common to at least two bins.

6. An apparatus according to claim 1, further comprising bin position detecting means provided in said first sheet material gripping and conveying means, and detecting means provided in said second sheet material gripping and conveying means for detecting a position of said first sheet material gripping and conveying means.

7. An apparatus according to claim 4, further comprising detecting means for detecting that the sheet material is gripped by said first sheet material gripping and conveying means, and control means for controlling said second sheet material gripping and conveying means to return it to a position for receiving the sheet material, when said detecting means detect the gripping of the sheet material by said first sheet material gripping and conveying means.

8. A sheet material distributing apparatus, comprising:

a plurality of movable bins for accommodating sheet materials, each of said bins having a sheet material inlet;

a first sheet material gripping and conveying means opposed to the sheet material inlet of each of said bins;

second sheet material gripping and conveying means linearly movable to receive one of the sheet materials from a sheet material discharging device to transfer the sheet material to said first sheet material gripping and conveying means.

9. An apparatus according to claim 8, further comprising a pressure releasing mechanism for removing a sheet material gripping force of said second sheet material gripping and conveying means when it returns to a position for receiving the sheet material from the sheet material discharging device.

10. An apparatus according to claim 8, further comprising means for controlling a conveying speed $V_R$ of said second sheet material gripping and conveying means to be V1+V2 during a period when said second sheet material gripping and conveying means returns to a position for receiving the sheet material discharging device, when V1 is a sheet material conveying speed of said first sheet material gripping and conveying speed of said first sheet material gripping and conveying means, and V2 is a returning speed of said second sheet material gripping and conveying means.

11. An apparatus according to claim 8, further comprising bin position detecting means provided in said first sheet material gripping and conveying means, and detecting means provided in said second sheet material gripping and conveying means for detecting a position of said first sheet material gripping and conveying means.

12. An apparatus according to claim 8, further comprising detecting means for detecting that the sheet material is gripped by said first sheet material gripping and conveying means, and control means for controlling said second sheet material gripping and conveying means to return it to a position for receiving the sheet material, when said detecting means detect the gripping of the sheet material by said first sheet material gripping and conveying means.

13. An image forming apparatus, comprising:

sheet discharging means for discharging sheet materials on which images have been formed;

a plurality of bins, arranged in a direction, for accommodating the sheet materials each of said bins having a sheet material inlet;

a first sheet material gripping and conveying means movable in the direction to be opposed to the sheet material inlet of each of said bins;

second sheet material gripping and conveying means movable in the direction to receive one of the sheet materials from said sheet discharging means to transfer the sheet material to said first sheet material gripping and conveying means.

14. An image forming apparatus, comprising:

sheet discharging means for discharging sheet materials on which images have been formed;

a plurality of movable bins arranged in a direction, for accommodating the sheet materials each of said bins having a sheet material itself;

first sheet material gripping and conveying means which is opposed to the sheet material inlet of each of said bins;

second sheet material gripping and conveying means movable in the direction to receive one of the sheet materials from said sheet discharging means to transfer the sheet martial to said first sheet material gripping and conveying means.

* * * * *

UNITED STATES PATENT AND TRADEMARK OFFICE

CERTIFICATE OF CORRECTION

PATENT NO. : 4,900,009

DATED : February 13, 1990

INVENTOR(S) : MAKOTO KITAHARA

It is certified that error appears in the above-identified patent and that said Letters Patent is hereby corrected as shown below:

COLUMN 1

Line 8, "sheet a" should read --a sheet--.
Line 14, "sheet" (second occurrence) should read --sheet---.

COLUMN 2

Line 30, "61 an 62." should read --61 and 62.--.

COLUMN 3

Line 44, "set" should read --said--.

COLUMN 6

Line 10, "hereinafter" should read --will hereinafter--.
Line 35, "belt 35 and 35" should read--belts 35 and 35--.
Line 67, "view of" should read --view, respectively, of--.

COLUMN 7

Line 35, "are; respectively" should read --are, respectively,--.
Line 50, "upwardly" should read --upward--.

COLUMN 9

Line 19, "and" should be deleted.

UNITED STATES PATENT AND TRADEMARK OFFICE

CERTIFICATE OF CORRECTION

PATENT NO. : 4,900,009

DATED : February 13, 1990

INVENTOR(S) : MAKOTO KITAHARA

It is certified that error appears in the above-identified patent and that said Letters Patent is hereby corrected as shown below:

COLUMN 10

Line 48, "For the" should read --The--.

COLUMN 11

Line 37, "sheet" should be deleted.

COLUMN 12

Line 59, "clockwisely" should read --clockwise--.

COLUMN 16

Line 16, "bins i and j," should read --bins 1i and 1j,--.

COLUMN 17

Line 20, "stationary" should read --stationarily--.
Line 27, "reflected" should read --deflected--.
Line 32, "chain receiving member 9,." should read -- chain receiving member 109.--.
Line 36, "motor 12" should read --motor 112--.

COLUMN 18

Line 50, "wisely" should read --wise--.

UNITED STATES PATENT AND TRADEMARK OFFICE

CERTIFICATE OF CORRECTION

PATENT NO. : 4,900,009

DATED : February 13, 1990

INVENTOR(S) : MAKOTO KITAHARA

It is certified that error appears in the above-identified patent and that said Letters Patent is hereby corrected as shown below:

COLUMN 19

Line 1, "claim 4," should read --claim 1,--.
Line 7, "detect" should read --detects--.
Line 35, "when" should read --where--.
Line 36, "speed of" should be deleted.
Line 37, "said first sheet material gripping and conveying" should be deleted.

COLUMN 20

Line 11, "detect" should read --detects--.
Line 17, "bins," should read --bins-- and "direction," should read --direction--.
Line 18, "materials" should read --materials,--.
Line 32, "materials" should read --materials,--.
Line 33, "sheet material itself;" should read --sheet material inlet;--.
Line 40, "sheet martial" should read --sheet material--.

Signed and Sealed this

Fifth Day of March, 1991

*Attest:*

HARRY F. MANBECK, JR.

*Attesting Officer*

*Commissioner of Patents and Trademarks*